US009132671B2

(12) United States Patent
Hannig

(10) Patent No.: US 9,132,671 B2
(45) Date of Patent: Sep. 15, 2015

(54) DEVICE AND METHOD FOR IMPROVED DIRECT PRINTING OF DECORATIVE PANELS

(71) Applicant: AKZENTA PANEELE+PROFILE GMBH, Kaisersesch (DE)

(72) Inventor: Hans-Jürgen Hannig, Bergisch Gladbach (DE)

(73) Assignee: Akzenta Paneele + Profile GMBH (DE)

( * ) Notice: Subject to any disclaimer, the term of this patent is extended or adjusted under 35 U.S.C. 154(b) by 0 days.

(21) Appl. No.: 14/352,144

(22) PCT Filed: Oct. 2, 2013

(86) PCT No.: PCT/EP2013/070586
§ 371 (c)(1),
(2) Date: Apr. 16, 2014

(87) PCT Pub. No.: WO2014/053569
PCT Pub. Date: Apr. 10, 2014

(65) Prior Publication Data

US 2014/0285604 A1 Sep. 25, 2014

(30) Foreign Application Priority Data

Oct. 4, 2012 (EP) ..... 12187205

(51) Int. Cl.
*B41J 11/02* (2006.01)
*B41J 3/407* (2006.01)
*B41J 11/00* (2006.01)

(52) U.S. Cl.
CPC *B41J 11/02* (2013.01); *B41J 3/407* (2013.01); *B41J 11/0015* (2013.01)

(58) Field of Classification Search
CPC ..... B41J 11/0015
USPC ..... 347/104; 361/214; 399/303
See application file for complete search history.

(56) References Cited

U.S. PATENT DOCUMENTS 4,814,795 A 3/1989 Kuester et al.
5,420,743 A * 5/1995 Domes ..... 361/214

(Continued)

FOREIGN PATENT DOCUMENTS

JP H07133035 A 5/1995
JP 2002046258 A 2/2002
JP 2003094851 A 4/2003
JP 2005028769 A 2/2005

OTHER PUBLICATIONS

"Conductivity of Metals Sorted by Resistivity"-http://eddy-current.com/conductivity-of-metals-sorted-by-resistivity/ Nov. 6, 2014.*

(Continued)

*Primary Examiner* — Stephen Meier
*Assistant Examiner* — John P Zimmermann
(74) *Attorney, Agent, or Firm* — Senniger Powers LLP

(57) ABSTRACT

The present invention relates to a device for improved direct printing of decorative panels and a method for improved direct printing of decorative panels. The present invention suggests a panel printing device comprising a feeder for a carrier to be printed, a printer and discharger, characterized in that the panel printing device comprises at least electrostatic discharger for discharging electrostatic charges from the carrier and at least electrostatic charger for supplying electrostatic charges onto the carrier which is disposed downstream of the electrostatic discharger for discharging electrostatic charges from the carrier.

20 Claims, 1 Drawing Sheet

(56) References Cited

U.S. PATENT DOCUMENTS

| | | | | |
|---|---|---|---|---|
| 6,097,408 | A * | 8/2000 | Fukushima et al. | 347/34 |
| 6,634,729 | B1 | 10/2003 | Schuman et al. | |
| 7,591,551 | B2 * | 9/2009 | Imoto et al. | 347/104 |
| 2001/0028381 | A1 * | 10/2001 | Kashiwagi et al. | 347/104 |
| 2002/0021312 | A1 * | 2/2002 | Matsumoto | 347/1 |
| 2003/0206755 | A1 * | 11/2003 | Wright et al. | 399/303 |
| 2006/0109325 | A1 | 5/2006 | Araya et al. | |
| 2007/0091146 | A1 * | 4/2007 | Endo et al. | 347/55 |
| 2008/0239042 | A1 | 10/2008 | Gauss et al. | |
| 2011/0102490 | A1 * | 5/2011 | Yamada et al. | 347/16 |

OTHER PUBLICATIONS

International Search Report, PCT/EP2013/070586, dated Dec. 11, 2013, 4 pages.
Abstract of JP2005028769; Feb. 3, 2005.
Abstract of JP2003094851; Apr. 3, 2003.
Abstract of JP2002046258; Feb. 12, 2002.
Abstract of JPH07133035; May 23, 1995.

* cited by examiner

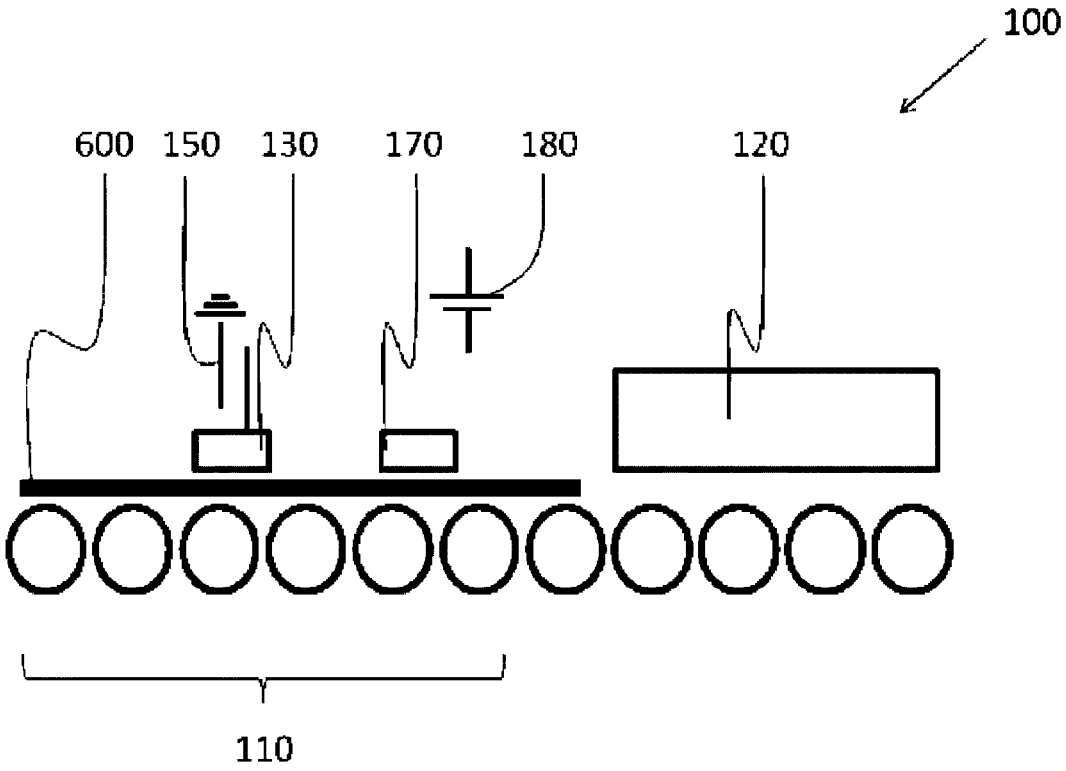
100
600
150
130
170
180
120
110

DEVICE AND METHOD FOR IMPROVED DIRECT PRINTING OF DECORATIVE PANELS

REFERENCE TO RELATED APPLICATIONS

This application is a U.S. national stage application of International Patent Application No. PCT/EP2013/070586, filed Oct. 2, 2013, and claims the benefit of European Application No. 12187205.5, filed Oct. 4, 2012, the entire disclosures of which are incorporated herein by reference.

FIELD OF THE INVENTION

The present invention relates to a device for improved direct printing of decorative panels and a method for improved direct printing of decorative panels.

BACKGROUND

The term decorative panel in the sense of the invention means wall, ceiling or floor panels comprising a decor applied to a carrier plate. Decorative panels are used in various ways in the field of interior construction of rooms as well as for the decorative cladding of structures, for example in exhibition stand constructions. One of the most common areas of application of decorative panels is their usage as a floor paving. Herein, the decorative panels often have a decor which should simulate a natural material.

Examples of such simulated natural materials are wood species such as maple, oak, birch, cherry wood, ash, walnut, chestnut, wenge or exotic wood such as Panga-Panga, mahogany, bamboo and Bubinga. Moreover, natural materials, such as stone surfaces or ceramic surfaces, are often simulated.

Hitherto such decorative panels are often manufactured as laminates in which a decorative paper preprinted with a desired decor is applied on a carrier plate and a so-called overlay, in turn, is applied onto the decorative layer. After a counteracting paper has been applied on the side of the carrier plate opposing the decorative paper, if desired, the layered structure obtained is firmly bonded together by means of appropriate pressure and/or heat-activated adhesives.

Dependent on the desired areas of application of the decorative panels they could be produced from different materials. Herein, in particular the material of the carrier can be selected in dependence of the area of application. Thus, the carrier, for example, can consist of a wood-based material, inasmuch as the decorative panel is not exposed to excessive moisture or weather conditions. If the panel, for example, is to be used in wet rooms or in the outdoor area, the carrier, for example, can consist of a plastic material.

Herein, wood-based materials in the sense of the invention in addition to solid wood-based materials comprise materials such as plywood board, composite lumber, blockboard, veneer plywood, laminated veneer lumber, parallel strand lumber and bending plywood. In addition wood-based materials in the sense of the invention are understood to include chipboards such as pressboards, extruded boards, oriented structural boards (OSB) and laminated strand lumber as well as wood fibre materials such as wood fibre insulation boards (HFD), hard and medium-hard fibreboards (MB, HFH) and particularly medium-density fibreboards (MDF) and high-density fibreboards (HDF). Moreover, modern wood-based materials such as wood-polymer materials (wood plastic composite, WPC), sandwich boards made of a lightweight core material such as foam, hard foam or paper honeycombs and a wood layer applied thereon as well as chipboards minerally hardened, for example with cement, are wood-based materials in the sense of the invention. Moreover, cork represents a wood-based material in the sense of the invention.

Plastic materials which can be used in the production of corresponding panels are, for example, thermoplastics such as polyvinyl chloride, polyolefines (such as polyethylene (PE), polypropylene (PP)), polyamides (PA), polyurethanes (PU), polystyrene (PS), acrylonitril butadiene styrene (ABS), polymethyl methacrylate (PMMA), polycarbonate (PC), polyethylene terephthalate (PET), polyether ether ketone (PEEK) or mixtures or copolymerizates thereof. The plastic materials can include common fillers, such as calcium carbonate (chalk), aluminum oxide, silicagel, quartz powder, wood flour, gypsum. In addition they can be coloured in a known way.

In the sense of the invention the term "direct printing" means applying a decor directly onto the carrier of a panel or onto an unprinted fibre material layer applied to the carrier. In contrast to conventional methods in which a decorative layer previously printed with a desired decor is applied onto the carrier in direct printing the decor is printed directly in the course of the panel production. Herein, different printing techniques can be used such as flexographic printing, offset printing or silk-screen printing. Herein, in particular digital printing techniques can be used such as inkjet methods and laser printing methods.

In the sense of the invention the term fibre materials means materials such as paper and non-woven fabrics on the basis of plant, animal, mineral or even synthetic fibres as well as cardboards. Examples of fibre materials on the basis of plant fibres in addition to papers and non-woven fabrics made of cellulose fibres are biomass such as straw, maize straw, bamboo, leaves, algae extracts, hemp, cotton or oil palm fibres. Examples of animal fibres are keratin-based materials such as wool or horsehair. Examples of mineral fibre materials are mineral wool or glass wool.

For protecting the applied decorative layer normally a wearing or top layer is applied on top of the decorative layer. A wearing and/or top layer in the sense of the invention is a layer applied as an outer finish which particularly protects the decorative layer against wear or damage by dirt, influence of moisture or mechanical impacts such as abrasion. Herein it can be provided that the wearing layer includes hard materials such as titan nitride, titan carbide, silicon nitride, silicon carbide, boron carbide, tungsten carbide, tantalum carbide, aluminum oxide (corundum), zircon oxide or mixtures thereof, in order to increase the wear resistance. Herein, it can be provided that the hard material is included in an amount between 5% by weight and 40% by weight, preferably between 15% by weight and 25% by weight, in the composition of the wearing layer. The hard material preferably has an average core diameter between 10 μm and 250 μm, more preferably between 10 μm and 100 μm. In this way it is achieved in a preferred way that the composition of the wearing layer forms a stable dispersion and a decomposition or precipitation of the hard material within the composition of the wearing layer can be avoided. For the formation of a corresponding wearing layer according to one embodiment of the invention it is provided that the composition including hard material and adapted to be cured by radiation is applied with a concentration between 10 $g/m^2$ and 250 $g/m^2$, preferably between 25 $g/m^2$ and 100 $g/m^2$. The application can be implemented, for example, by rollers, such as rubber rollers, or by means of pouring devices. According to a further embodiment of the invention it can be provided that the hard material at the time of application of the composition of the wearing layer is not included within the composition, but is spread in the form of particles onto the applied composition of the wearing layer and subsequently is cured.

In many cases it is provided that a surface texture matching with the decor is included in such wearing or top layers. A surface texture matching with the decor means that the surface of the decorative panel comprises a haptic structure which according to its shape and pattern corresponds to the applied decor such as to achieve a reproduction of a natural material as close to the original as possible even with respect to the haptic. Herein, it can be provided that the carrier plate already comprises a texture and an alignment of a printing tool for applying the decor with respect to the carrier plate is implemented by means of the texture of the carrier plate which is detected by optical methods. Herein, for aligning the printing tool and the carrier plate relative to each other a relative movement between the printing tool and the carrier plate necessary for the alignment is implemented by shifting the carrier plate or by shifting the printing tool. According to a further embodiment of the invention it is provided that a texturing of the decorative panel is implemented subsequently to the application of the top and/or wearing layer. To this end it can be preferred to apply as the top and/or wearing layer a curable composition and a curing process is done only to an extent that only a partial curing of the top and/or wearing layer is achieved. In the thus partially cured layer by means of appropriate tools, such as a hard metal texture roller or a die, a desired surface texture is embossed. Herein, the embossing process is implemented corresponding to the applied decor. In order to ensure a sufficient matching of the texture to be produced with the decor it may be provided that the carrier plate and the embossing tool are to be aligned to each other by corresponding relative movements. Subsequently to the production of the desired texture within the partially cured top and/or wearing layer a further curing step is implemented with respect to the now textured top and/or wearing layer.

One problem that may occur during direct printing of decorative panels is that a deterioration of the print image occurs in the course of the production process. Dependent on the selected printing method a visible blurring of the print image can occur during the production process. If, for example, an inkjet method is used for applying the decor, after a certain production time period a clearly recognizable blurring occurs in the decor print image which is not attributable to possible contaminations of the printhead or a change of the ink.

SUMMARY OF THE INVENTION

Considering that, it is an object of the present invention to provide a device and a method which are able to overcome the problem known in the prior art.

This object is achieved with a device according to claim 1 and a method according to claim 8. Embodiments of the invention are specified in the dependent claims and in the further description.

Thus, according to the invention a panel printing device is suggested which comprises a feeder for a carrier to be printed and a printer, characterized in that the panel printing device comprises at least one electrostatic discharger for discharging electrostatic charges from the carrier and at least one electrostatic charger for supplying electrostatic charges onto the carrier disposed downstream of the electrostatic discharger.

BRIEF DESCRIPTION OF THE DRAWING

FIG. 1 is a schematic illustration of the panel printing device of the invention.

DETAILED DESCRIPTION OF PREFERRED EMBODIMENTS

Surprisingly it has been found that the provision of an electrostatic discharger for discharging electrostatic charges from the carrier to be printed in combination with at least one electrostatic charger for supplying electrostatic charges onto the carrier disposed downstream of the electrostatic discharger for discharging electrostatic charges is adapted to avoid the occurrence of blurrings in the course of the production process. The undefined electrostatic charge within the carrier to be printed, which builds up in the course of the production process, results in an undefined deflection of the colour or ink drops on their way from the printhead to the surface to be printed. Herein, it is assumed that the electrostatic field which builds up on the carrier deflects the normally positively charged ink particles in an unpredictable way such that they will not impinge on the intended point on the surface to be printed. The thus induced inaccuracy of the application of colour results in a visible blurring of the print image. Dependent on the production speed and the selected carrier material this effect occurs in different manifestations such that it is assumed that carriers are charged electrostatically in dependence of the carrier material due to their transport within the production plant and this charging is sufficient to induce the observed effect.

Because an electrostatic charger for supplying electrostatic charges onto the carrier is provided by adjusting a defined electrostatic charge of the carrier and particularly of the carrier surface, respectively, the undefined deflection of ink drops due to an unpredictable electrostatic charging can be avoided. Herein, it surprisingly has been found that the print image compared to the sole discharge of electrostatic charges can further be improved.

Because the electrostatic charger is disposed downstream, i.e. in the moving direction of the carrier behind, an electrostatic discharger and particularly spaced thereto, herein a particular precise electrostatic charge can be applied into and onto the carrier, respectively. Because at first the electrostatic charges are completely removed the carrier can have a particular uniform and defined electrostatic charge and charging, respectively, during the print process, because local peak charges can be prevented from occuring. Herein, the way, i.e. positive or negative polarity, and the quantity of the introduced or applied charge can be selected depending on the carrier material and/or the printing method and/or other factors.

For example, the electrostatic charger, such as a charging system, can comprise a charge generator for positive (+) or negative (−) polarity and as well be connected to a mains adapter or power supply in order to apply charges onto the carrier or the carrier surface.

Thus, by providing an electrostatic discharger for discharging electrostatic charges from the carrier to be printed in combination with at least one electrostatic charger for supplying electrostatic charges onto the carrier disposed downstream of the electrostatic discharger for discharging electrostatic charges from the carrier the print image in direct printing onto the carrier can be improved significantly.

According to an embodiment of the invention it is provided that the electrostatic discharger for discharging electrostatic charges from the carrier and/or the electrostatic charger for supplying electrostatic charges onto the carrier is configured as a bar comprising a surface which extends essentially parallel to a surface of the carrier and is directed towards the direction of the carrier. In particular, this surface of the bar serving as an active charging and discharging surface, respectively, can extend over the entire width of the carrier, i.e. essentially in an orientation perpendicular to the moving direction of the carrier over the entire dimension of the carrier. Herein, a surface of the bar extending essentially parallel to the surface of the carrier can particularly mean, that the bar at least within the region which is electrostatically discharging or charging substantially has a uniform distance, such as with a deviation of 20%, particularly 10%, e.g. 1%, from the carrier.

Such a bar can particularly be a member which is configured approximately rectangular and comprises two leveled aligned surfaces which are disposed in the direction of the carrier and in the opposite direction. For example, the electrostatic discharger and/or the electrostatic charger can be configured as a plane grinded bar. In particular with this configuration corona discharges can be avoided and peak charges or changes of charge can be prevented effectively such that a discharge and particularly an electrostatic charging with production of a highly uniform charge distribution can be realised particularly uniform and defined such that the print image, too, can be particularly defined and of high quality. Herein, an electrostatic charging can be realised by applying a defined voltage to the bar, wherein the type and the magnitude of the electrostatic charging can be influenced or adjusted by the type and the magnitude of the voltage. Herein, by electrically contacting the bar with the moving carrier the electrostatic charging can be improved. The same applies to an electrostatic discharging, wherein in this case, too, the discharging can be implemented by applying a voltage or by connecting to an electrical ground potential.

According to an embodiment of the invention it is provided that the electrostatic discharger for discharging electrostatic charges at least comprises a roll, a brush or a lip made of a conductive material which electrically contacts the carrier at least in the region of the printer and which is connected to an electrical ground potential. The electrical ground potential, for example, can be provided by earthing.

In one embodiment of the invention it is provided that the discharge of the electrical charge is realised through a roll which is part of the feeder of the printer. In this way a compact structure of the device can be achieved. According to a particular preferred embodiment of the invention it can be provided that a plurality of the means used for the transport of the carrier within the production line for producing decorative panels are configured such that possibly occuring electrostatic charges can be discharged over these means.

The bar, the roll, the brush or the lip at least in the region of contact with the carrier are formed of a material comprising a conductivity of $\geq 1 \cdot 10^3$ $Sm^{-1}$. Herein, in particular it can be provided that the electrical resistance between the carrier and the ground potential is $\leq 0.5\Omega$, preferably $\leq 0.05\Omega$.

The bar, the roll, the brush or the lip by means of which the carrier is contacted can, for example in the contact region with the carrier, be made of an electrically conductive metal such as steel, chrome, copper, aluminum, silver, or a conductive alloy such as brass or bronze. According to a further embodiment of the invention the roll, the brush or the lip at least partially consists of a conductive plastic material. Examples of appropriate electrically conductive plastic materials are poly-3,4-ethylene dioxythiophene, doped polythiophene, doped polyethine, polyaniline and polypyrrol. An advantage of such conductive plastic materials over metals is that plastic materials are softer than metals such that a possible damage of the carrier by scratching can be avoided. Alternatively it can be provided that the roll, the brush or the lip at least at the contact points with the carrier consists of a conductive tissue. This, for example, can be a synthetic tissue into which metal threads are woven.

According to a further embodiment of the invention it can be provided that it comprises an ionizer disposed upstream of the printer, by means of which an ionized airflow is guided over the carrier to be printed. It has been found that biasing with ionized air is adapted to decrease or increase the electrostatic charging of the carrier.

According to a particularly preferred embodiment of the invention the printer comprises an inkjet printhead.

Regarding the method the object is achieved by methods for direct printing of decorative panels, including the process steps:

providing a carrier to be printed;

supplying the carrier to a printer; and printing a decor onto the carrier by means of the printer;

characterized in that the carrier is treated with charge changers for changing the electrostatic charging of the carrier before the carrier is supplied to the printer and/or during the printing process within the printer, by initially electrostatically discharging the carrier and subsequently supplying a defined charge amount to the carrier.

Regarding the technical features and advantages of the method it is completely referred to the description of the device and vice versa.

According to an embodiment of the invention a discharging process is conducted within a range of 7 kV or more, particularly 10 kV or more, such as in a range between 7 kV or more and 15 kV or less. As an alternative or in addition an electrostatic charging process can be conducted independently from the kind of the charge within a range between more than 0 kV and 15 kV or less, such as 10 kV or less. It surprisingly has been found that in particular a discharging process by a predetermined charge amount and/or a charging process by a predetermined charge amount can result in a particular good print image.

According to one embodiment of the method the the electrostatic discharger for decreasing the electrostatic charge includes an electrical contact of the carrier with the ground potential. Herein it can be provided that the contact of the carrier is implemented by means of a bar, a roll, a brush or a lip made of a material having an electrical conductivity $\geq 1 \cdot 10^3$ $Sm^{-1}$.

According to a further embodiment of the method according to the invention it can be provided that the carrier is biased with an ionized airflow before and/or during the transport to the printer. It has been found that biasing with an ionized airflow is adapted to significantly decrease or increase an electrostatic charge within the carriers.

Hereinafter the invention is explained with reference to a FIGURE.

FIG. 1 shows a panel printing device 100. The device 100 comprises a feeder 110 fur supplying a carrier 600 to be printed by means of which the carrier 600 is supplied to a printer 120. The printer 120 comprises an inkjet printhead for applying a decor image onto the carrier under the control of a computer system. The device 100 comprises an electrostatic discharger 130 for discharging electrostatic charges from the carrier 600 which may contact the carrier 600 and further comprises an electrostatic charger 170 for supplying electrostatic charges onto the carrier 600 which is disposed downstream of the electrostatic discharger 130 for discharging electrostatic charges from the carrier 600 and may also contact the carrier 600. Herein, the electrostatic discharger 130 and the electrostatic charger 170 are disposed in the region of the feeder 110 and are formed of a rectangular bar made of a conductive material, wherein the electrostatic discharger 130 is connected to a ground potential by means of an earthing 150 and the feeder 170 is connected to a mains adapter 180 or a power source.

LIST OF REFERENCE SYMBOLS

100 Panel printing device
110 Feeder
120 Printer
130 Electrostatic discharger
150 Earthing
170 Electrostatic charger
180 Mains adapter
600 Carrier

The invention claimed is:

1. Panel printing device, comprising a feeder for a carrier to be printed and a printer, characterized in that the panel printing device comprises at least one electrostatic discharger for discharging electrostatic charges from a surface to be printed of the carrier and at least one electrostatic charger for supplying electrostatic charges onto the surface to be printed of the carrier disposed downstream of the electrostatic discharger.

2. Device according to claim 1, characterized in that the electrostatic discharger for discharging electrostatic charges from the carrier and/or the electrostatic charger for supplying electrostatic charges onto the carrier are configured as a bar which comprises a surface extending essentially parallel to a surface of the carrier and directed towards the direction of the carrier.

3. Device according to claim 1, wherein the electrostatic discharger for discharging electrostatic charges at least comprises a roll, a brush or a lip made of a conductive material which electrically contacts the carrier at least in the region of the printer and which is connected to an electrical ground potential.

4. Device according to claim 3, wherein the bar, the roll, the brush or the lip at least in the contact region with the carrier is made of a material comprising a conductivity of $\geq 1 \cdot 10^3\ Sm^{-1}$.

5. Device according to claim 3, wherein the bar, the roll, the brush or the lip at least partially are made of an electrically conductive plastic material.

6. Device according to claim 1, wherein the electrostatic discharger comprises an ionized airflow for discharging the carrier.

7. Device according to claim 1, wherein the printer comprises an inkjet printhead.

8. Method for direct printing of decorative panels, comprising the process steps of:

providing a carrier to be printed;

supplying the carrier to a printer; and printing a decor onto the carrier by means of the printer;

characterized in that the carrier is treated with charge changers for changing the electrostatic charge of a surface to be printed of the carrier before the carrier is supplied to the printer and/or during the printing process within the printer by initially electrostatically discharging the surface to be printed of the carrier and subsequently supplying a defined charge amount to the surface to be printed of the carrier.

9. Method according to claim 8, characterized in that a discharging process is conducted within a range of 7 kV or more.

10. Method according to claim 8, characterized in that the electrostatic charging is conducted within a range of 0 kV or more and 15 kV or less.

11. Method according to claim 8, wherein the electrostatic discharger for decreasing the electrostatic charge includes an electrical contact of the carrier with a ground potential.

12. Method according to claim 8, wherein the contacting of the carrier is implemented by a rectangular bar, a roll, a brush or a lip made of a material having an electrical conductivity of $\geq 1 \cdot 10^3\ Sm^{-1}$.

13. Method according to claim 8, wherein the carrier is biased with an ionized airflow before and/or during the transport to the printer.

14. A panel printing device comprising:

a feeder for a carrier to be printed;

an electrostatic discharger for discharging electrostatic charges from a surface to be printed of the carrier;

an electrostatic charger for supplying electrostatic charges to the surface to be printed of the carrier after said discharging, wherein the electrostatic charger is downstream of the electrostatic discharger; and a printer downstream of the electrostatic charger.

15. Device according to claim 1, wherein the electrostatic charger and the electrostatic discharger directly face the surface to be printed of the carrier.

16. Device according to claim 1, wherein the electrostatic charger comprises an ionized airflow for charging the surface to be printed of the carrier.

17. Device according to claim 1, wherein the electrostatic discharger comprises a conductive material which contacts the surface to be printed of the carrier.

18. Device according to claim 1, wherein the electrostatic charger comprises a conductive material which contacts the surface to be printed of the carrier.

19. Device according to claim 6, wherein the electrostatic charger comprises an ionized airflow for charging the surface to be printed of the carrier.

20. Device according to claim 1, wherein the electrostatic charger and the electrostatic discharger contact the surface to be printed of the carrier.

* * * * *